United States Patent [19]

Yokoyama et al.

[11] Patent Number: 4,555,480

[45] Date of Patent: Nov. 26, 1985

[54] SILVER HALIDE PHOTOGRAPHIC LIGHT-SENSITIVE MATERIAL CONTAINING A POLYOXYETHYLENE SURFACTANT AND A NITRON COMPOUND

[75] Inventors: Shigeki Yokoyama; Koki Nakamura; Jyounichi Kouda; Nobuhisa Sekiguchi, all of Kanagawa, Japan

[73] Assignee: Fuji Photo Film Co., Ltd., Kanagawa, Japan

[21] Appl. No.: 657,699

[22] Filed: Oct. 4, 1984

[30] Foreign Application Priority Data

Oct. 4, 1983 [JP] Japan ..... 58-185304

[51] Int. Cl.[4] ..... G03C 1/82

[52] U.S. Cl. ..... 430/527; 430/600; 430/615; 430/623; 430/630

[58] Field of Search ..... 430/527, 600, 615, 623, 430/630

[56] References Cited

U.S. PATENT DOCUMENTS

| | | | |
|---|---|---|---|
| 3,850,641 | 11/1974 | Horigome et al. | 430/529 |
| 3,915,710 | 10/1975 | Habu et al. | 430/614 |
| 4,272,616 | 1/1981 | Kishimoto | 430/530 |

*Primary Examiner*—Jack P. Brammer
*Attorney, Agent, or Firm*—Sughrue, Mion, Zinn, Macpeak & Seas

[57] ABSTRACT

A silver halide photographic light-sensitive material comprising a support having thereon at least one light-sensitive silver halide emulsion layer, wherein the light-sensitive silver halide emulsion layer or other layer is a hydrophilic colloid layer containing a polyoxyethylene surface active agent represented by general formula (I) or (II) described below, and a nitron compound selected from nitron, an inorganic acid salt thereof and an organic acid salt thereof.

(I)

(II)

wherein $R_1$, $R_2$, $R_6$ and $R_8$, which may be the same or different, each represents a hydrogen atom, a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group; $R_5$ and $R_7$, which may be the same or different, each represents a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group, provided that $R_5$ and $R_6$ or $R_7$ and $R_8$ may combine to form a substituted or unsubstituted ring; $R_3$ and $R_4$ each represents a hydrogen atom, a substituted or unsubstituted alkyl group, a substituted or unsubstituted aryl group or a substituted or unsubstituted $\alpha$-furyl group, provided that $R_3$ and $R_4$ may combine to form a ring; $n_1$, $n_2$, $n_3$ and m, which may be the same or different, each is an integer of from 2 to 50; and in general formula (II) the substituents represented by $R_5$, $R_6$, $R_7$ and $R_8$ on the two benzene rings may be bilaterally symmetrical or asymmetrical.

The silver halide photographic light-sensitive material has an excellent antistatic property and development processing aptitude, along with excellent photographic properties and screen contamination properties. The antistatic properties of the material are not reduced with the passage of time.

26 Claims, No Drawings

SILVER HALIDE PHOTOGRAPHIC LIGHT-SENSITIVE MATERIAL CONTAINING A POLYOXYETHYLENE SURFACTANT AND A NITRON COMPOUND

FIELD OF THE INVENTION

The present invention relates to a silver halide photographic light-sensitive material (hereinafter referred to as a "photographic light-sensitive material"), and particularly to a photographic light-sensitive material having both an improved antistatic property and an improved development processing aptitude.

BACKGROUND OF THE INVENTION

Since photographic light-sensitive materials are generally composed of a support having an electrically insulating property and photographic layers, static charges often accumulate during production or use of the photographic light-sensitive materials, caused by contact friction between surfaces of the light-sensitive material or with other materials, or by separation thereof. Such accumulated static charges cause various problems, the most serious of which is that the light-sensitive emulsion layer can be exposed to light by discharge of accumulated static charges prior to development. This causes dot like spots or resinous or feathery linear spots upon development processing of the photographic film. This phenomenon of static marks greatly reduces the commercial value of the photographic films or results in its complete loss. For example, it is evident that static marks could result in a dangerous misinterpretation when they appear on medical or industrial X-ray films. Since this phenomenon becomes evident for the first time after development, processing, it is very troublesome. Further, the accumulated static charges cause secondary problems, for example, causing dust to adhere to the surface of the film or preventing uniform application of photographic layers to the film.

Such static charges often accumulate when producing photographic light-sensitive materials or using them, as described above. For example, during production, they are generated by contact friction between a photographic film and a roll, or by separation of the support face and the emulsion face when winding or rewinding the photographic film. Further, they are generated in an automatic photographing apparatus by contact of an X-ray film with machine parts or by contact of an X-ray film with fluorescent sensitizing paper or the separation therefrom. In addition, they are generated by contact of film with packing materials. Static marks caused by accumulation of such static charges increase rather substantially with increases in the sensitivity of photographic light-sensitive material, and increase with a faster processing rate. Particularly in recent years, static marks have become a more serious problem, because photographic light-sensitive materials now commonly have high sensitivity and are often subjected to severe handling in high speed applications, high speed photography or high speed automatic processing.

In order to reduce the problems created by static electricity, antistatic agents are preferably added to photographic light-sensitive materials. Antistatic agents utilized in photographic light-sensitive materials must have different characteristics than antistatic agents conventionally used in other fields because of various characteristic restrictions applicable to photographic light-sensitive materials. Antistatic agents for use in photographic light-sensitive materials must not only have excellent antistatic properties but they must not adversely affect photographic properties such as sensitivity, fog, granularity of sharpness, etc. In addition, they must not reduce the film strength of the photographic light-sensitive materials (i.e., reduce resistance to scratches formed by friction or scratching), they must not diminish antiadhesive properties (i.e., permit the surface of the photographic light-sensitive material to easily adhere to another surface of the photographic light-sensitive material or other surfaces), they must not promote exhaustion of solutions used for processing the photographic light-sensitive materials, and they must not reduce the adhesive strength between layers of the photographic light-sensitive materials. Accordingly, the application of antistatic agents to photographic light-sensitive materials is subjected to a number of significant restrictions.

One method of reducing static electricity is by increasing the electrical conductivity of the surface of the photographic light-sensitive material in order to quickly discharge static charges prior to the discharge of the accumulated charges and thus prevent accumulated charges.

Various methods of increasing the electrical conductivity of the support of the photographic light-sensitive materials, and various surface coating layers are known, including the use of hygroscopic substances and water-soluble inorganic salts, certain kinds of surface active agents and polymers. For example, the use of polymers is described in U.S. Pat. Nos. 2,882,157, 2,972,535, 3,062,785, 3,262,807, 3,514,291, 3,615,531, 3,753,716 and 3,938,999, the use of surface active agents is described in U.S. Pat. Nos. 2,982,651, 3,428,456, 3,457,076, 3,454,625, 3,552,972 and 3,655,387, and the use of metal oxides and colloidal silica is described in U.S. Pat. Nos. 3,062,700, 3,245,833 and 3,525,621.

However, it is very difficult to apply these substances generally to photographic light-sensitive materials, because they are particularly suited for one kind of film support or photographic composition. Accordingly, while they produce good results when used with a specific film support, photographic emulsion, or other photographic element, they are useless for preventing static charges when used with different film supports and photographic elements. They may have excellent antistatic properties but adversely affect photographic properties such as sensitivity of photographic emulsions, fog, granularity or sharpness. They may have excellent antistatic properties immediately after production, but which deteriorate with the passage of time.

It is also very important that the photographic properties of photographic light-sensitive materials are not significantly changed depending on conditions of development processing such as development temperature or degree of exhaustion of the developing solution. Particularly, in recent years, high temperature rapid development processing has become generally used, and slight changes in the conditions of such processing tend to significantly alter the photographic properties of photographic light-sensitive materials. When the photographic properties are greatly influenced by a slight change in the conditions of development processing as described above, it is impossible to obtain images of constant quality, greatly reducing the commercial value of the photographic light-sensitive materials.

It is also known that nonionic surface active agents having one polyoxyethylene chain in a molecule described in British Pat. No. 861,134 and German Pat. No. 1,422,309 have excellent antistatic properties. Some of these nonionic surface active agents having one polyoxyethylene chain in a molecule can prevent changes in photographic properties resulting from variations in conditions of development processing as described above. However, they have serious disadvantages when they are applied to photographic light-sensitive materials. Specifically, (1) they remarkably reduce sensitivity, (2) since their antistatic properties deteriorate with the passage of time, although they have good antistatic properties immediately after production, the antistatic properties of products are inferior by the time when the products are used, (3) in particular, when used in X-ray materials, dotted or meshlike uneven density (which is called "screen contamination") results in the sensitive materials after development processing, because of their contact with sensitizing paper (i.e., a fluorescent screen) during exposure and (4) when applied to X-ray materials, dotted fog results in the materials after development processing using an automatic developing machine. It can be easily understood that the commercial value of photographic light-sensitive materials with such disadvantages is remarkably reduced.

A proposal to prevent the change of photographic properties caused by variations in conditions of development processing, by incorporating an inorganic acid salt or organic acid salt of nitron in photographic light-sensitive materials is described in Japanese Patent Application (OPI) No. 22626/75. (The term "OPI" as used herein refers to a "published unexamined Japanese patent application", hereinafter the same). Although the incorporation of an inorganic acid salt or organic acid salt of nitron can reduce the change of photographic properties due to variations in development temperature or degree exhaustion of developing solution to some extent, the effect is insufficient and it is very difficult to obtain images of constant quality by the use of these compounds alone. It is quite difficult to produce photographic light-sensitive materials having both excellent antistatic properties and excellent photographic properties which are not significantly affected by variations in development processing conditions.

SUMMARY OF THE INVENTION

An object of the present invention is to provide an effective antistatic photographic light-sensitive material which does not adversely affect photographic properties such as sensitivity.

Another object of the present invention is to provide an antistatic photographic light-sensitive material having excellent photographic properties that are not significantly affected by variations in development processing conditions and which provide images of constant quality.

Yet another object of the present invention is to provide an antistatic photographic light-sensitive material which does not exhibit screen contamination.

A further object of the present invention is to provide an antistatic photographic light-sensitive material having antistatic properties which are stable after production.

Other objects of the present invention will be apparent from the following detailed description and examples.

As the result of various investigations on development of photographic light-sensitive materials having both excellent antistatic properties and excellent photographic properties that are not significantly affected by variations in development processing conditions and provide images of constant quality, the present inventors have found that the above-described problems are surprisingly overcome and the above-described objects are attained by a photographic light-sensitive material incorporating a polyoxyethylene surface active agent represented by general formula (I) or (II) described below together with nitron, an inorganic acid salt thereof or an organic acid salt thereof.

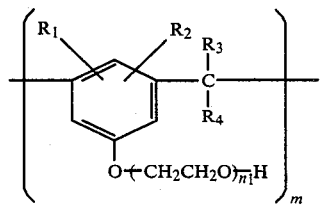

(I)

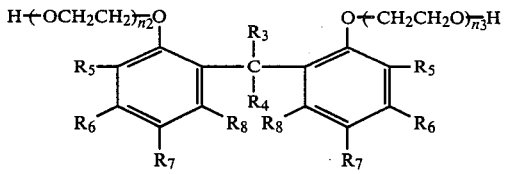

(II)

wherein $R_1$, $R_2$, $R_6$ and $R_8$, which may be the same or different, each represents a hydrogen atom, a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group; $R_5$ and $R_7$, which may be the same or different, each represents a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group, provided that $R_5$ and $R_6$ or $R_7$ and $R_8$ may combine to form a substituted or unsubstituted ring; $R_3$ and $R_4$ each represents a hydrogen atom, a substituted or unsubstituted alkyl group, a substituted or unsubstituted aryl group or a substituted or unsubstituted $\alpha$-furyl group, provided that $R_3$ and $R_4$ may combine to form a ring; $n_1$, $n_2$ and $n_3$, which may be the same or different, each is an integer of from 2 to 50; m is an integer of from 2 to 50; and in general formula (II) the substituents represented by $R_5$, $R_6$, $R_7$ and $R_8$ on the two benzene rings positioned on the right side and the left side may be bilaterally symmetrical or asymmetrical.

DETAILED DESCRIPTION OF THE INVENTION

In preferred polyoxyethylene compounds according to the present invention, $R_1$, $R_2$, $R_5$, $R_6$, $R_7$ and $R_8$ each represents preferably a substituted or unsubstituted alkyl group having from 1 to 20 carbon atoms such as a methyl group, an ethyl group, an i-propyl group, a t-butyl group, a t-amyl group, a t-hexyl group, a t-octyl group, a nonyl group, a decyl group, a dodecyl group, a trichloromethyl group, a tribromoethyl group, a 1-phenylethyl group or a 2-phenyl-2-propyl group; a substituted or unsubstituted aryl group such as a phenyl group or a p-chlorophenyl group; a substituted or unsubstituted alkoxy group represented by $—OR_{13}$ (wherein $R_{13}$ represents a substituted or unsubstituted alkyl group having from 1 to 20 carbon atoms or a substituted or unsubstituted aryl group), a halogen atom such as a chlorine atom or a bromine atom; a substituted or unsubstituted acyl group represented by $—COR_{13}$ (wherein $R_{13}$ is the same as defined above), a substituted or unsubstituted amido group represented by $—NR_{14}COR_{13}$ (wherein $R_{14}$ represents a hydrogen atom or an alkyl group having from 1 to 20 carbon atoms); a substituted or unsubstituted sulfonamido group represented by $—NR_{14}SO_2R_{13}$ (wherein $R_{13}$ and $R_{14}$ are each the same as defined above); a substituted or unsubstituted carbamoyl group represented by

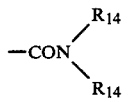

or a substituted or unsubstituted sulfamoyl group represented by

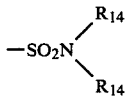

(wherein $R_{14}$, which may be the same or different, is each the same as defined above); and $R_1$, $R_2$, $R_6$ and $R_8$ each may be a hydrogen atom.

Among them, it is preferred that $R_5$ and $R_7$ each represents an alkyl group or a halogen atom. It is particularly preferred that $R_5$ represents a bulky tertiary alkyl group such as a t-butyl group, a t-amyl group, or a t-octyl group. Further, $R_5$ and $R_6$ or $R_7$ and $R_8$ may combine to form a substituted or unsubstituted ring, including a naphthalene ring. It is particularly preferred that $R_6$ and $R_8$ each represents a hydrogen atom.

$R_3$ and $R_4$ each represents preferably a hydrogen atom, a substituted or unsubstituted alkyl group such as a methyl group, an ethyl group, an n-propyl group, an i-propyl group, an n-heptyl group, a 1-ethylamyl group, an n-undecyl group, a trichloromethyl group or a tribromomethyl group, a substituted or unsubstituted aryl group such as a phenyl group, a naphthyl group, a p-chlorophenyl group, a p-methoxyphenyl group or an m-nitrophenyl group, or an α-furyl group. Further, $R_3$ and $R_4$ may combine to form a ring, including a cyclohexane ring. Among them, it is particularly preferred that $R_3$ and $R_4$ each represents a hydrogen atom, an alkyl group having from 1 to 8 carbon atoms, a phenyl group or an α-furyl group. It is particularly preferred that $n_1$, $n_2$ and $n_3$ each is from 5 to 30. $n_2$ and $n_3$ may be the same or different.

Of the polyoxyethylene surface active agents represented by the general formula (I) or (II), polyoxyethylene surface active agents having two polyoxyethylene chains in a molecule represented by general formula (II) are particularly preferred.

The polyoxyethylene surface active agents represented by general formulae (I) and (II) can be synthesized by the methods described, for example, in U.S. Pat. No. 3,850,641, Japanese Patent Application (OPI) Nos. 89626/79 and 109947/82, Japanese Patent Application Nos. 85764/82 and 90909/82, and Hiroshi Horiguchi, *Shin Kaimen Kasseizai* (Sankyo Shuppan Co., 1975), etc.

The nitron which can be used in the present invention is another name for 1,4-diphenyl-endoanilino-dihydrotriazole, and its chemical structure, a method for its preparation and its properties are described in *Kagaku Daijiten,* edited by Kagaku Daijiten Editorial Committee, Vol. 6, page 802 (Kyoritsu Shuppan Co., 1963). Further, in *Journal of the Chemical Society,* Vol. 1, pages 824 to 825 (1938), the following structural formulae A and B for nitron are disclosed.

Structural Formula A

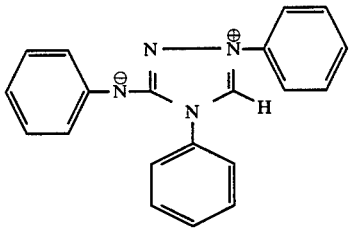

Structural Formula B

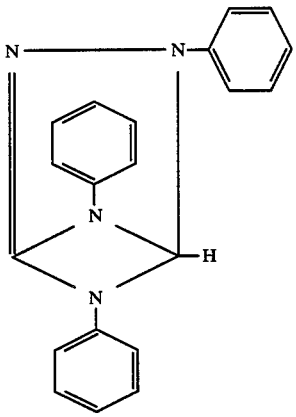

Nitron can form a salt together with an inorganic acid or an organic acid. Examples of inorganic acid salts include hydrochloride, hydrobromide, perchlorate, nitrate, and thiocyanate sats. Examples of organic acid salts include acetate, propionate, benzoate, and salicylate salts. In the present invention, inorganic acid salts of nitron and organic acid salts of nitron are preferred, and organic acid salts are more preferred. Salicylate of nitron is most preferred.

Specific examples of polyoxyethylene surface active agents used in the present invention are set forth below, but the present invention should not be construed as being limited thereto.
I-1
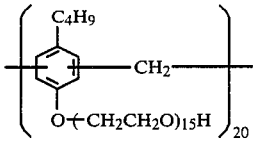
I-2
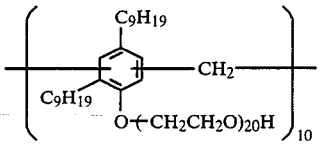
I-3
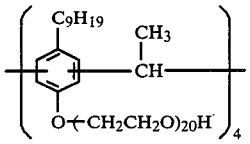
I-4
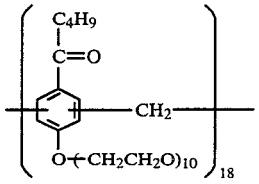
I-5
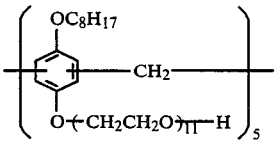
I-6
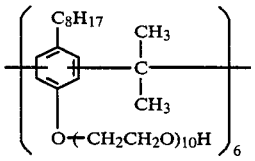
I-7
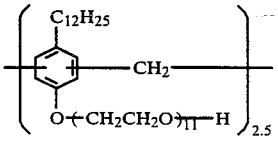
II-1
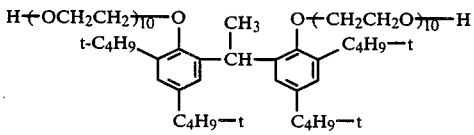
II-2
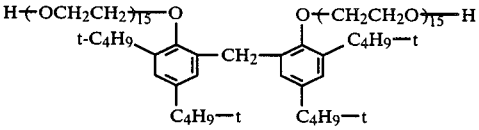
-continued
II-3
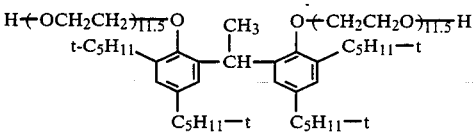
II-4
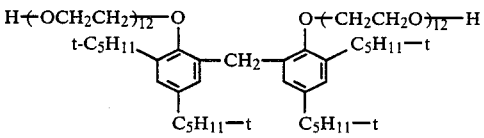
II-5
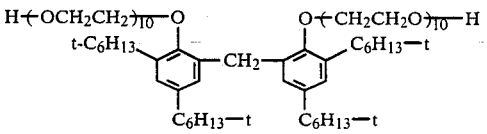
II-6
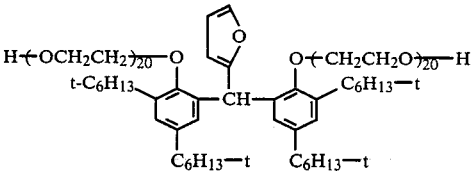
II-7
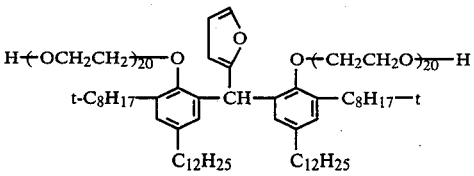
II-8
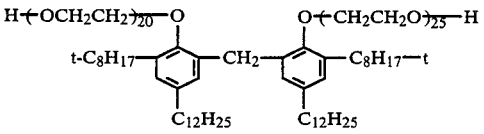
II-9
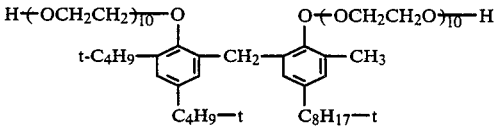
II-10
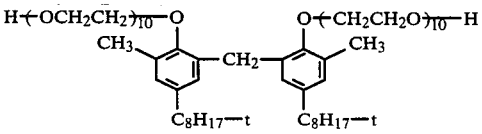
II-11
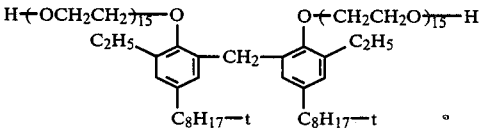
II-12
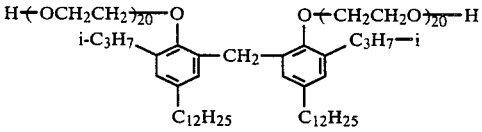

-continued
II-13
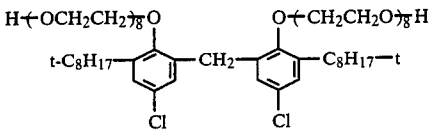
II-14
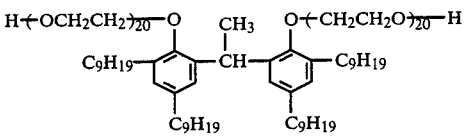
II-15
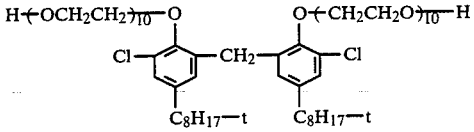
II-16
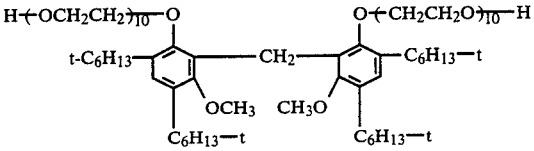
II-17
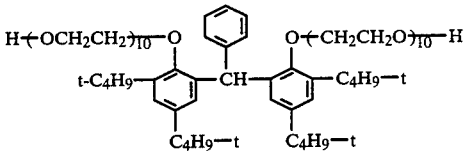
II-18
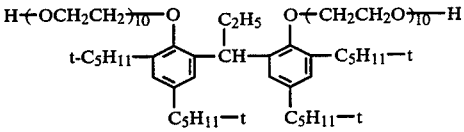
II-19
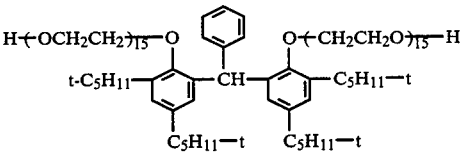
II-20
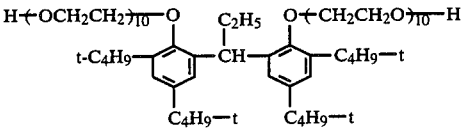
II-21
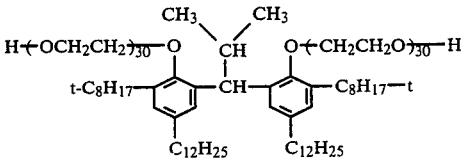
II-22
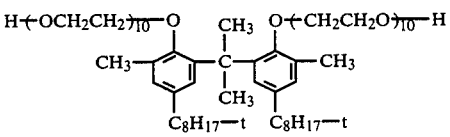
-continued
II-23
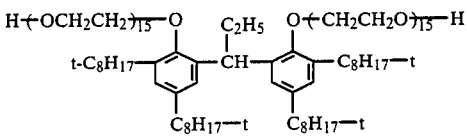
II-24
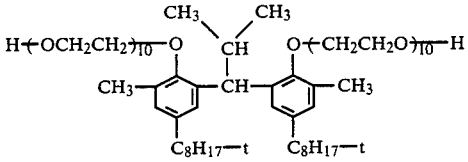
II-25
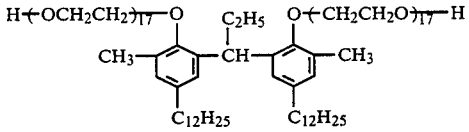
II-26
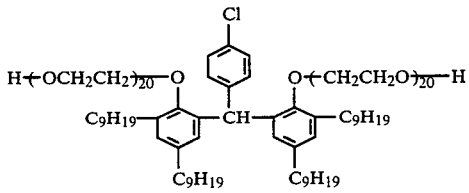
II-27
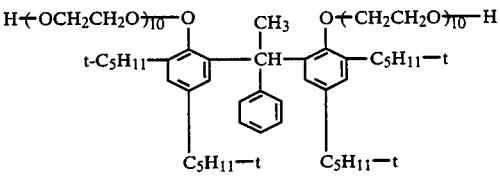
II-28
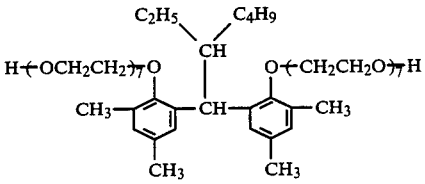
II-29
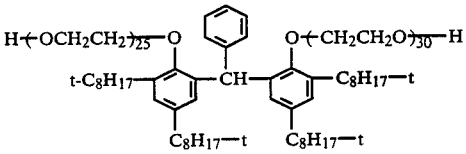
II-30
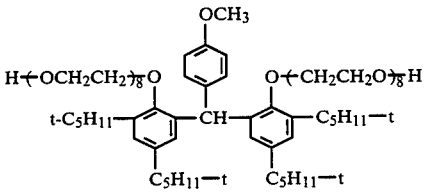
II-31
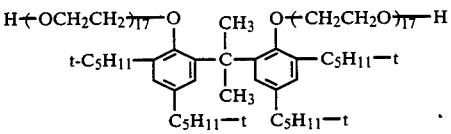

-continued

II-32

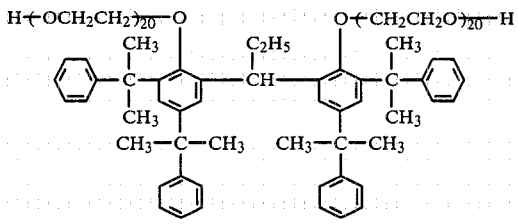

II-33

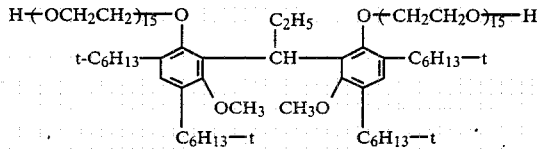

II-34

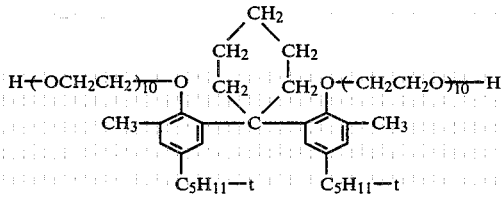

II-35

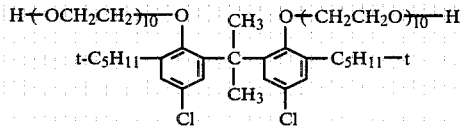

II-36

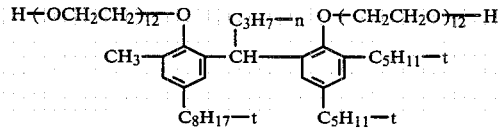

II-37

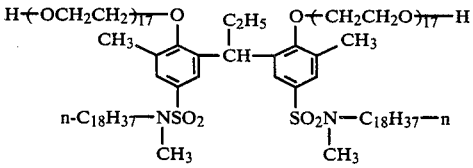

II-38

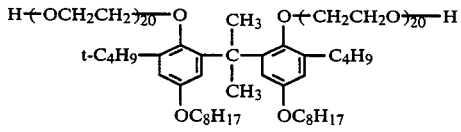

II-39

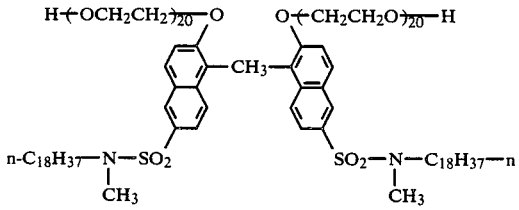

II-40

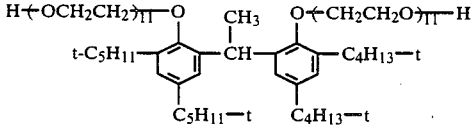

-continued

II-41

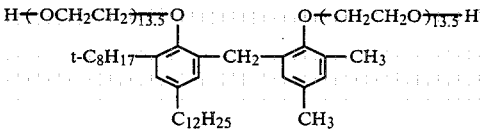

II-42

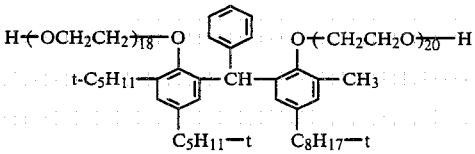

II-43

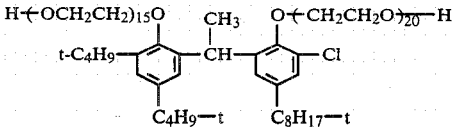

Specific examples of nitron, inorganic acid salts thereof and organic acid salts thereof used in the present invention are set forth below, but the present invention should not be construed as being limited thereto.

III-1 Nitron (free form)
III-2 Nitron hydrochloride
III-3 Nitron hydrobromide
III-4 Nitron perchlorate
III-5 Nitron nitrate
III-6 Nitron thiocyanate
III-7 Nitron sulfate
III-8 Nitron hydroiodide
III-9 Nitron benzoate
III-10 Nitron salicylate
III-11 Nitron acetate
III-12 Nitron propionate
III-13 Nitron p-toluenesulfonate The amount of the polyoxyethylene surface active agent represented by general formula (I) or (II) used varies according to the type of photographic light-sensitive material used or the coating process, etc., but it is general from about 5 to 500 mg, particularly preferably from about 20 to 200 mg, per $m^2$ of the photographic light-sensitive material.

The amount of nitron, an inorganic acid salt thereof or an organic acid salt thereof used also varies according to the kind of light-sensitive silver halide emulsion used in the photographic light-sensitive material, but it is generally from about $10^{-8}$ to $10^{-1}$ mol, preferably from about $5\times10^{-5}$ to $1\times10^{-2}$ mol, and more preferably from about $2\times10^{-4}$ to $7\times10^{-3}$ mol, per g of silver atom.

In order to apply the polyoxyethylene surface active agent represented by general formula (I) or (II) according to the present invention to layers in the photographic light-sensitive materials, it is dissolved in water or an organic solvent such as methanol, ethanol or acetone, etc., or a solvent mixture composed of water and the above-described organic solvent, and the resulting solution is then introduced into a light-sensitive emulsion layer or a light-insensitive layer (for example, a backing layer, an antihalation layer, an interlayer or a protective layer) on the support, or the solution is applied to the surface of the support, by any conventional means including spraying, coating or dipping, followed by drying. Although the polyoxyethylene surface active agent can be applied to any layers in the photographic light-sensitive material, it is preferred that the polyoxyethylene surface active agent is applied to the protective layer or backing layer.

Nitron, an inorganic acid salt thereof or an organic acid salt thereof according to the present invention is preferably added to a light-sensitive emulsion layer of the photographic light-sensitive material, but it may be added to a light-insensitive layer. In order to introduce the nitron compound into the layer, it can be added as it is or as a solution thereof dissolved in water, an organic solvent as described above or a solvent mixture composed of water and the above-described organic solvent to a coating solution for forming the layer and the resulting coating solution is coated and dried.

The polyoxyethylene surface active agent represented by general formula (I) or (II) according to the present invention and nitron, an inorganic acid salt thereof or an organic acid salt thereof according to the present invention may be incorporated into the same layer or different layers of the photographic light-sensitive material. Further, these compounds according to the present invention may be incorporated into two or more layers. Preferably, these compounds are incorporated into a silver halide emulsion layer or layers.

Silver halide particles in the photographic emulsion used in the photographic light-sensitive material of the present invention may have a regular crystal form, e.g., a cubic or octagonal crystal form, or an irregular crystal form, e.g., spherical and tabular crystal forms, or may have composite crystal forms thereof. A mixture of particles having various crystal forms may be used.

These photographic emulsions can be prepared by the methods as described in, for example, P. Glafkides, *Chimie et Physique Photographique,* Paul Montel (1967), C. F. Duffin, *Photographic Emulsion Chemistry,* The Focal Press (1966), and V. L. Zelikman et al., *Making and Coating Photographic Emulsion,* The Focal Press (1964); that is, they can be prepared in any suitable conventional manner, e.g., by an acidic process, a neutral process, and an ammonia process. Also, soluble silver salts and soluble halides can be reacted in any suitable manner, e.g., a oneside mixing process, a simultaneous mixing process, and a combination thereof.

Binders used in the photographic layers include proteins such as gelatin, or casein, etc., cellulose compounds such as carboxymethyl cellulose or hydroxyethyl cellulose, etc., saccharose derivatives such as agar, sodium alginate or starch derivatives, etc., synthetic hydrophilic colloids such as polyvinyl alcohol, poly-N-vinylpyrrolidone, polyacrylic acid copolymer, polyacrylamide or derivatives or partially hydrolyzed products thereof. They may be used alone or as a mixture of two or more binders.

Gelatin as used herein means lime-treated gelatin, acid-treated gelatin and enzyme-treated gelatin.

Further, the photographic light-sensitive material of the present invention may contain alkyl acrylate latexes as described in U.S. Pat. Nos. 3,411,911 and 3,411,912 and Japanese Patent Publication No. 5331/70 in the photographic layers.

Silver halide emulsions are usually subjected to chemical sensitization although they can be used as so-called primitive emulsions without application of chemical sensitization. This chemical sensitization can be performed by the methods described in the above-described references by P. Glafkides, and V. L. Zelikman et al., and H. Frieser ed., *Die Grundlagen der Photographischen Prozesse mit Silberhalogeniden,* Akademische Verlagsgellschaft (1968).

In more detail, the chemical sensitization can be, for example, a sulfur sensitization process using compounds containing sulfur capable of reacting with silver ions or active gelatin, a reduction sensitization process using reducing substances, or a noble metal sensitization process using noble metal compounds, e.g., gold compounds, which can be used alone or in combination with each other. Sulfur sensitizing agents which can be used include thiosulfuric acid salts, thioureas, thiazoles, and rhodanines, typical examples of which are described in U.S. Pat. Nos. 1,574,944, 2,410,689, 2,278,947, 2,728,668 and 3,656,955. Reduction sensitizing agents which can be used include stannous salts, amines hydrazine derivatives, formamizinesulfinic acid, and silane compounds, typical examples of which are described in U.S. Pat. Nos. 2,487,850, 2,419,974, 2,518,698, 2,983,609, 2,983,610 and 2,694,637. For noble metal sensitization, complex salts of Group VIII metals of the periodic table, e.g., platinum, iridium, and palladium, as well as gold complex salts can be used. Typical examples are described in U.S. Pat. Nos. 2,399,083 and 2,448,060 and British Pat. No. 618,061.

The light-sensitive material of the present invention may contain a number of antifoggants or stabilizers, including azoles, such as benzothiazolium salts, nitroindazoles, triazoles, benzotriazoles, and benzimidazoles (particularly, nitro- or halogen-substituted compounds); heterocyclic mercapto compounds, such as mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines, and derivatives of heterocyclic mercapto compounds containing water-soluble groups, such as a carboxyl group and a sulfo group; thioketo compounds, such as oxazolinthione; azaindenes, such as tetraazaindenes (particularly, 4-hydroxy-substituted (1,3,3a,7)tetraazaindenes); benzenethiosulfonic acids; and benzenesulfinic acids.

Specific examples of the above-described compounds, and methods of using them are disclosed in U.S. Pat. Nos. 3,954,474, 3,982,947 and 4,021,248 and Japanese Patent Publication No. 28660/77.

In the light-sensitive material of the present invention, one or more layers may contain a hardener. Examples of useful hardeners include aldehye compounds such as mucochloric acid, mucobromic acid, mucophenoychloric acid, mucophenoxybromic acid, formaldehyde, dimethylol urea, trimethylol melamine, glyoxal, monomethyl glyoxal, 2,3-dihydroxy-1,4,-dioxane, 2,3-dihydroxy-5-methyl-1,4-dioxane, succinaldehyde, 2,5-dimethoxytetrahydrofuran or glutaraldehyde; active vinyl compounds such as divinyl sulfone, methylene-bismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazine, bis(vinylsulfonylmethyl)ether, 1,3-bis(vinylsulfonylmethyl)propanol-2 or bis(α-vinylsulfonylacetamido)ethane; active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethylamino)-s-triazine or N,N'-bis(2-chloroethylcarbamoyl)-piperazine; epoxy compounds such as bis(2,3-epoxypropyl)-methylpropyl ammonium p-toluenesulfonate, 1,4-bis(2',3'-epoxypropyloxy)butane, 1,3,5-triglycidylisocyanurate or 1,3-diglycidyl-5-

(γ-acetoxy-β-oxypropyl)isocyanurate; ethyleneimine compounds such as 2,4,6-triethyleneimino-s-triazine, 1,6-hexamethylene-N,N'-bisethylene urea or bis-β-ethyleneiminoethyl thioether; methanesulfonic acid esters such as 1,2-di(methanesulfonyloxy)ethane, 1,4-di(methanesulfonyloxy)butane or 1,5-di(methanesulfonyloxy)pentane; carbodiimide compounds; isoxazole compounds; and inorganic compounds such as chromium alum.

Further, the photographic emulsion layers and other constituting layers in the photographic light-sensitive material of the present invention may contain various surface active agents other than those of the present invention for various purposes, e.g., as coating aids or antistatic agents, or for improving slipping properties, accelerating emulsification and dispersion, preventing adhesion, or improving photographic characteristics (e.g., acceleration of development, increasing contrast, and sensitization).

Surfactants which can be used include nonionic surfactants, such as saponin (steroid type), alkyleneoxide derivatives (e.g., polyethylene glycol, a condensate of polyethylene glycol and polypropylene glycol, polyethylene glycol alkyl ethers or polyethylene glycol alkylaryl ethers, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglyceride, and alkylphenol polyglyceride), fatty acid esters of polyhydric alcohols, and alkyl esters of saccharides; anionic surfactants containing acidic groups, such as a carboxyl group, a sulfo group, a phospho group, a sulfuric acid ester group, and a phosphoric acid ester group, e.g., alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltauric acid, sulfosuccinic acid esters, sulfoalkylpolyoxyethylene alkylphenyl ethers, and polyoxyethylene alkylphosphoric acid esters; amphoteric surfactants, such as amino acids, aminoalkylsulfonic acids, aminoalkylsulfuric acid or phosphoric acid esters, alkylbetaines, and amineoxides; and cationic surfactants, such as alkylamine salts, aliphatic or aromatic quaternary ammonium salts, heterocyclic quaternary ammonium salts, e.g., pyridinium and imidazolium, and aliphatic or heterocyclic ring-containing phosphonium or sulfonium salts.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as a basic heterocyclic nucleus, is applicable to these dyes, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and nuclei formed by condensing alicyclic hydrocarbon rings with these nuclei, and nuclei formed by condensing aromatic hydrocarbon rings with these nuclei, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, or a quinoline nucleus. The carbon atoms of these nuclei can also be substituted.

The merocyanine dyes and the complex merocyanine dyes that can be employed contain 5- or 6-membered heterocyclic nuclei such as for example, a pyrazoline-5-one nucleus, a thiohydantoin nucleus, a 2-thioxazolidin-2,4-dione nucleus, a thiazolidin-2,4-dione nucleus, a rhodanine nucleus, and a thiobarbituric acid nucleus as a nucleus having a ketomethylene structure.

In the following, the present invention is illustrated in greater detail by reference to examples but the present invention is not to be construed as being limited to these examples. Unless otherwise indicated, all parts, percents and ratios are by weight.

EXAMPLE 1

(1) Preparation of Samples:

To a polyethylene terephthalate film support having a thickness of 180μ and having an undercoating, a silver halide emulsion layer having the following composition and a protective layer having the following composition were applied in that order and dried to prepare black-and-white silver halide light-sensitive materials. A nonionic surface active agent according to the present invention or a nonionic surface active agent for comparison was added to the protective layer, and a nitron compound according to the present invention was added to the emulsion layer.

| | |
|---|---|
| Emulsion Layer | |
| Thickness: about 5μ | |
| Composition and coating amount: | |
| Gelatin | 2.5 g/m$^2$ |
| Silver Iodobromide (silver iodide 1.5% by mol) | 5 g/m$^2$ |
| Nitron Compound According to the Present Invention | $5 \times 10^{-4}$ mol/mol of Ag |
| 1-Phenyl-5-mercaptotetrazole | 25 mg/m$^2$ |
| Protective Layer | |
| Thickness: about 1μ | |
| Composition and coating amount: | |
| Gelatin | 1.7 g/m$^2$ |
| 2,4-Dichloro-6-hydroxy-1,3,5-Triazine Sodium Salt | 10 mg/m$^2$ |
| Sodium N—Oleyl-N—methyltaurate | 7 mg/m$^2$ |
| Nonionic Surface Active Agent According to the Present Invention or Nonionic Surface Active Agent for Comparison | 40 mg/m$^2$ |

(2) Method of Determining Antistatic Property:

The antistatic property was determined by measuring surface resistance and the generation of static marks.

Measurement of the surface resistance was carried out by putting a test strip of the sample between brass electrodes (using stainless steel in the part in contact with the test strip) having a length of 10 cm with the space between electrodes of 0.14 cm and measuring a 1 minute value by means of an insulation tester: Type TR 8651 produced by Takeda Riken Co.

The static mark generation test was carried out by putting an unexposed sensitive material on a rubber sheet with the surface containing the antistatic agent facing the rubber sheet, pressing the sensitive material with a rubber roll, and separating it to generate static marks.

The surface resistivity was measured at 25° C. and 25% RH and the static mark generation test was carried out at 25° C. and 25% RH. Conditioning of the test strips of the sample was performed under the same conditions for 24 hours.

In order to evaluate the degree of generation of static marks, each sample was developed at 20° C. for 5 minutes with a developing solution having the following composition.

| Composition of Developing Solution: | |
|---|---|
| N—Methyl-p-aminophenol Sulfate | 4 g |
| Anhydrous Sodium Sulfite | 60 g |
| Hydroquinone | 10 g |
| Sodium Carbonate (monohydrate) | 53 g |
| Potassium Bromide | 25 g |
| Water to make | 1 liter |

The static marks were evaluated according to the following standard consisting of five stages.

A: Generation of static marks was not observed.

B: Static marks were slightly generated.

C: Static marks were considerably generated

D: Static marks were remarkably generated.

E: Static marks were generated in the whole area.

(3) Method of Testing Deterioration with Passage of Time.

After samples prepared as in (1) above and high quality white paper were conditioned at 25° C. and 70% RH for 1 hour, the high quality paper was put between two samples so that both sides of the high quality paper came into contact with the surface of the emulsion layer side of the samples, and they were put in a polyethylene laminated bag and sealed. These samples were allowed to stand at 25° C. for 1 week while applying a weight of 50 g/m$^2$. Thereafter, the antistatic property was measured according to the above-described method and the value obtained was compared with that before the passage of time.

(4) Method of Testing Photographic Properties:

Sample prepared as in (1) above was exposed to light by a tungsten lamp through a filter SP-14 produced by Fuji Photo Film Co., Ltd., and it was developed with a developing solution having the following composition (at 35° C. for 30 seconds), fixed and washed. Then, photographic properties were examined.

| Composition of Developing Solution: | |
|---|---|
| Hot Water (40° C.) | 800 ml |
| Sodium Tetrapolyphosphate | 2.0 g |
| Anhydrous Sodium Sulfite | 50 g |
| Hydroquinone | 10 g |
| Sodium Carbonate (monohydrate) | 40 g |
| 1-Phenyl-3-pyrazolidone | 0.3 g |
| Potassium Bromide | 2.0 g |
| Water to make | 1,000 ml |

(5) Measurement of Degree of Screen Contamination:

Test strips and a screen LT-II produced by Dainippon Toryo Co. were conditioned at 30° C. and 80% RE for 1 day. After 1,000 test strips were passed through a cassette using this screen LT-II under the same conditions, X-ray photographs were made and the degree of uneven density in the X-ray was examined.

The degree of screen contamination was evaluated according to the following standard consisting of four stages.

A: Generation of uneven density was not observed.

B: Uneven density was slightly generated.

C: Uneven density was considerably generated.

D: Uneven density was remarkably generated.

Results of each test (2) to (5) are shown in Table 1.

TABLE 1

| Sample No. | Polyoxyethylene Surface Active Agent | Nitron Compound | Antistatic Property: Before Passage of Time: Surface Resistance (Ω) | Before Passage of Time: Static Marks | After Passage of Time: Surface Resistance (Ω) | After Passage of Time: Static Marks | Photographic Sensitivity* (relative value) | Degree of Screen Contamination |
|---|---|---|---|---|---|---|---|---|
| 1 | Compound I-3 of the Invention | Nitron Acetate | $4.5 \times 10^{11}$ | A | $5.1 \times 10^{12}$ | B | 91 | B |
| 2 | Compound I-7 of the Invention | Nitron Salicylate | $2.7 \times 10^{11}$ | A | $3.5 \times 10^{12}$ | B | 93 | B |
| 3 | Compound II-1 of the Invention | Nitron Salicylate | $2.3 \times 10^{11}$ | A | $3.1 \times 10^{11}$ | A | 96 | A |
| 4 | Compound II-3 of the Invention | Nitron Salicylate | $2.7 \times 10^{11}$ | A | $3.2 \times 10^{11}$ | A | 99 | A |
| 5 | Compound II-4 of the Invention | Nitron Hydrochloride | $3.8 \times 10^{11}$ | A | $4.4 \times 10^{11}$ | A | 98 | A |
| 6 | Compound II-19 of the Invention | Nitron Acetate | $3.5 \times 10^{11}$ | A | $3.4 \times 10^{11}$ | A | 96 | A |
| 7 | Comparative Compound A | Nitron Acetate | $4.2 \times 10^{11}$ | A | $8.3 \times 10^{13}$ | D | 78 | D |
| 8 | Comparative Compound B | Nitron Salicylate | $2.9 \times 10^{11}$ | A | $7.0 \times 10^{13}$ | D | 74 | D |
| 9 | — | — | $7.7 \times 10^{14}$ | E | $8.0 \times 10^{14}$ | E | 100 | A |

Comparative Compound A $n\text{-}C_{12}H_{25}O\text{-}(CH_2CH_2O)_{10}\text{-}H$ (British Patent No. 861,134)

Comparative Compound B

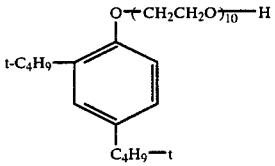

*The sensitivity was a relative value determined from a reciprocal of a logarithm of an exposure amount necessary for obtaining a density of (fog + 1.0), when the sensitivity of Sample No. 9 is taken as 100.

It is apparent from the results shown in Table 1 that in the photographic light-sensitive materials containing the polyoxyethylene surface active agent represented by the general formula (I) or (II) according to the present invention and nitron, an inorganic acid salt thereof or an organic acid salt thereof according to the present invention, the surface resistance is sufficiently low, static marks are not observed, the photographic sensitivity is not significantly reduced, and the degree of screen contamination is excellent. Further, this excellent antistatic property hardly changes with the passage of time.

In particular, compounds represented by general formula (II) such as Compounds II-1, II-3, II-4 and II-19 are generally preferred in comparison with compounds represented by the general formula (I) such as Compounds I-3 and I-7, although both show a remarkable antistatic effect.

In contrast, using Comparative Compounds A and B which have one polyoxyethylene chain in the molecule, the antistatic property before the passage of time is excellent, but it deteriorates sharply with the passage of time. Further, more those compounds greatly reduce the photographic sensitivity and increase the screen contamination.

EXAMPLE 2

Test for dependence of photographic properties on conditions of development processing (1) Preparation of Samples:

Black-and-white silver halide light-sensitive materials were prepared in the same manner as described in Example 1.

(2) Method of Testing:

The sample was cut into a test piece of 30.5 cm×25.4 cm and subjected to a fixed stepwise exposure with an optical wedge using a sensitometer. Then it was subjected to development processing by an automatic developing machine RU produced by Fuji Photo Film Co., Ltd., using three baths, i.e., a developing bath (Fuji Photo Film RD-III), a fixing bath (Fuji Photo Film Fuji-F 35° C.) and a water washing bath. The temperature of the developing bath was either 35° C. or 37° C. and the photographic properties obtained at each temperature were compared. Further, the photographic properties obtained by development processing at 35° C. with a developing solution which was prepared by adding 11.1 g of potassium bromide per liter of RD-III, to simulate an exhausted developing solution were compared with those obtained by development processing with a fresh developing solution of RD-III. The results obtained are shown in Table 2.

TABLE 2

| Sample No. | Polyoxyethylene Surface Active Agent | Nitron Compound | Fog: Fresh Developer 35° C. | Fog: Fresh Developer 37° C. | Fog: Exhausted Developer 35° C. | Sensitivity (relative value): Fresh Developer 35° C. | Sensitivity: Fresh Developer 37° C. | Sensitivity: Exhausted Developer 35° C. | Gradation (gamma): Fresh Developer 35° C. | Gradation: Fresh Developer 37° C. | Gradation: Exhausted Developer 35° C. |
|---|---|---|---|---|---|---|---|---|---|---|---|
| 11 | Compound I-3 of the Invention | Nitron Salicylate | 0.13 | ±0.00 | ±0.00 | 92 | +14 | +4 | 2.08 | +0.17 | −0.02 |
| 12 | Compound I-7 of the Invention | Nitron Salicylate | " | " | " | 93 | +15 | +3 | 2.12 | +0.15 | −0.01 |
| 13 | Compound II-1 of the Invention | Nitron Salicylate | " | " | " | 97 | +15 | +5 | 2.10 | +0.18 | −0.03 |
| 14 | Compound II-19 of the Invention | Nitron Salicylate | " | " | " | 97 | +20 | +6 | 2.09 | +0.16 | −0.01 |
| 15 | Comparative Compound A | Nitron Salicylate | " | " | " | 79 | +19 | +5 | 2.10 | +0.15 | ±0.00 |
| 16 | Comparative Compound B | Nitron Salicylate | " | " | " | 76 | +15 | +7 | 2.08 | +0.16 | −0.02 |
| 17 | — | Nitron Salicylate | 0.14 | +0.02 | +0.02 | 99 | +30 | +27 | 2.15 | +0.25 | −0.22 |
| 21 | Compound II-3 of the Invention | Nitron Salicylate | 0.13 | ±0.00 | ±0.00 | 99 | +17 | +3 | 2.10 | +0.15 | −0.02 |
| 22 | Compound II-3 of the Invention | Nitron Acetate | " | " | " | " | +19 | +7 | 2.11 | +0.19 | −0.05 |
| 23 | Compound II-3 of the Invention | Nitron Hydrochloride | " | " | +0.01 | " | +21 | +13 | 2.12 | +0.20 | −0.05 |
| 24 | Compound II-3 of the Invention | Nitron (free form) | " | +0.01 | +0.01 | 100 | +25 | +19 | 2.14 | +0.21 | −0.06 |
| 25 | Compound II-3 of the Invention | — | 0.15 | +0.03 | +0.03 | 100 | +45 | +30 | 2.20 | +0.40 | −0.35 |
| 31 | — | — | 0.15 | +0.04 | +0.03 | 100 | +45 | +32 | 2.22 | +0.39 | −0.38 |

*1Fog, sensitivity and gradation obtained with a fresh developer at 37° C. and an exhausted developer at 35° C. were determined by measuring the difference in fog, sensitivity and gradation obtained with a fresh developer at 35° C., respectively.

*2Comparative Compounds A and B are same as shown in Table 1.

In Table 2, the fog means a portion of Dmin of the characteristic curve; the sensitivity has the same meaning as in Table 1 except that Sample No. 31 is taken as a standard; and the gradation is expressed by a tangent of the inclination of a straight line connecting a density of 0.3 to a density of 1.5.

As is apparent from the results shown in Table 2, the photographic properties vary greatly depending on the development processing conditions in the photographic light-sensitive material which contained neither the polyoxyethylene surface active agent according to the present invention nor the nitron compound according to the present invention (Sample No. 31). In that sample, a 2° C. increase in developing temperature resulted in an increase in fog, an increase in sensitivity and a hardening in the gradation (gamma increased). On the other hand, the fog increased, the sensitivity increased, and the gradation became soft (gamma decreased) when developed with an exhausted developing solution. The great variation of photographic properties caused by a small change in the development processing conditions as described above remarkably reduces the commercial value of the photographic light-sensitive material.

In contrast the above-described defects were greatly improved by the combination use of the polyoxyethylene surface active agent and the nitron compound according to the present invention. That is, the increase in fog was limited to substantially zero, the degree of increase in sensitivity was small, and the degree of increase in gamma was small even when the developing temperature was increased. Further, the increase in fog was limited to substantially zero, the degree of increase in sensitivity was small, and the degree of decrease was limited to substantially zero when developed with an exhausted developing solution.

These improvements can be observed but their extent was small when nitron salicylate is used alone (Sample No. 17). Further, the above-described improvements were greater when using an organic acid salt of nitron than an inorganic acid salt of nitron, which was greater in turn than when using the free form of nitron, and particularly nitron salicylate resulted in the greatest improvement. (Sample Nos. 21 to 24).

With respect to the polyoxyethylene surface active agents, not only those represented by general formula (I) and those represented by general formula (II), but also Comparative Compounds A and B having one polyoxyethylene chain in the molecule, made almost the same improvement in the degree of dependence on development processing conditions. However, nonionic surface active agents having only one polyoxyethylene chain per molecule have the disadvantages previously described in Example 1, which prevent their effective use in photographic light-sensitive materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising a support having thereon at least one light-sensitive silver halide emulsion layer, wherein the light-sensitive silver halide emulsion layer or other layer is a hydrophilic colloid layer containing a polyoxyethylene surface active agent represented by general formula (I) or (II) described below, and a nitron compound selected from nitron, an inorganic acid salt thereof and an organic acid salt thereof, (I)

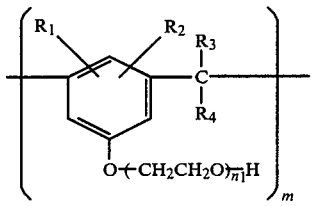

(II)

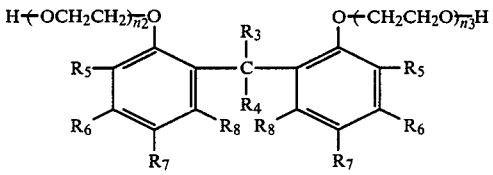

wherein $R_1$, $R_2$, $R_6$ and $R_8$, which may be the same or different, each represents a hydrogen atom, a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group; $R_5$ and $R_7$, which may be the same or different, each represents a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group, provided that $R_5$ and $R_6$ or $R_7$ and $R_8$ may combine to form a substituted or unsubstituted ring; $R_3$ and $R_4$ each represents a hydrogen atom, a substituted or unsubstituted alkyl group, a substituted or unsubstituted aryl group or a substituted or unsubstituted $\alpha$-furyl group, provided that $R_3$ and $R_4$ may combine to form a ring; $n_1$, $n_2$, $n_3$ and m, which may be the same or different, each is an integer of from 2 to 50; and in general formula (II) the substituents represented by $R_5$, $R_6$, $R_7$ and $R_8$ on the two benzene rings may be bilaterally symmetrical or asymmetrical.

2. A silver halide photographic light-sensitive element as claimed in claim 1, wherein one or more of the alkyl group(s) represented by $R_1$, $R_2$, $R_5$, $R_6$, $R_7$ or $R_8$ is an alkyl group having from 1 to 20 carbon atoms.

3. A silver halide photographic light-sensitive element as claimed in claim 1, wherein one or more of the alkoxy group(s) represented by $R_1$, $R_2$, $R_5$, $R_6$, $R_7$ or $R_8$ is represented by the formula $—OR_{13}$ wherein $R_{13}$ represents a substituted or unsubstituted alkyl group having from 1 to 20 carbon atoms or a substituted or unsubstituted aryl group.

4. A silver halide photographic light-sensitive element as claimed in claim 1, wherein one or more of the aryl group(s) represented by $R_1$, $R_2$, $R_5$, $R_6$, $R_7$ or $R_8$ is represented by the formula $—COR_{13}$ wherein $R_{13}$ represents a substituted or unsubstituted alkyl group having from 1 to 20 carbon atoms or a substituted or unsubstituted aryl group.

5. A silver halide photographic light-sensitive element as claimed in claim 1, wherein one or more of the amido group(s) represented by $R_1$, $R_2$, $R_5$, $R_6$, $R_7$ or $R_8$ is represented by the formula $—NR_{14}COR_{13}$ wherein $R_{13}$ represents a substituted or unsubstituted alkyl group having from 1 to 20 carbon atoms or a substituted or unsubstituted aryl group; and $R_{14}$ represents a hydrogen atom or an alkyl group having from 1 to 20 carbon atoms.

6. A silver halide photographic light-sensitive element as claimed in claim 1, wherein one or more of the sulfonamido group(s) represented by $R_1$, $R_2$, $R_5$, $R_6$, $R_7$ or $R_8$ is represented by the formula $—NR_{14}SO_2R_{13}$ wherein $R_{13}$ represents a substituted or unsubstituted alkyl group having from 1 to 20 carbon atoms or a substituted or unsubstituted aryl group; and $R_{14}$ represents a hydrogen atom or an alkyl group having from 1 to 20 carbon atoms.

7. A silver halide photographic light-sensitive element as claimed in claim 1, wherein one or more of the carbamoyl group(s) represented by $R_1$, $R_2$, $R_5$, $R_6$, $R_7$ or $R_8$ is represented by the formula

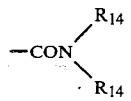

wherein $R_{14}$, which may be the same or different, each represents a hydrogen atom or an alkyl group having from 1 to 20 carbon atoms.

8. A silver halide photographic light-sensitive element as claimed in claim 1, wherein one or more of the sulfamoyl group(s) represented by $R_1$, $R_2$, $R_5$, $R_6$, $R_7$ or $R_8$ is represented by the formula

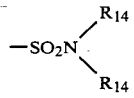

wherein $R_{14}$, which may be the same or different, each represents a hydrogen atom or an alkyl group having from 1 to 20 carbon atoms.

9. A silver halide photographic light-sensitive element as claimed in claim 1, wherein $R_5$ and $R_7$, which may be the same or different, each represents an alkyl group or a halogen atom.

10. A silver halide photographic light-sensitive element as claimed in claim 1, wherein $R_5$ represents a bulky tertiary alkyl group.

11. A silver halide photographic light-sensitive element as claimed in claim 1, wherein $R_5$ and $R_6$ or $R_7$ and $R_8$ combine to form a naphthalene ring.

12. A silver halide photographic light-sensitive element as claimed in claim 1, wherein $R_6$ and $R_8$ each represents a hydrogen atom.

13. A silver halide photographic light-sensitive element as claimed in claim 1, wherein $R_3$ and $R_4$ combine to form a cyclohexane ring.

14. A silver halide photographic light-sensitive element as claimed in claim 1, wherein $R_3$ and $R_4$, which may be the same or different, each represents a hydrogen atom, an alkyl group having from 1 to 8 carbon atoms, a phenyl group or an α-furyl group.

15. A silver halide photographic light-sensitive element as claimed in claim 1, wherein $n_1$, $n_2$ or $n_3$, which may be the same or different, each is from 5 to 30.

16. A silver halide photographic light-sensitive element as claimed in claim 1, wherein the polyoxyethylene surface active agent is a compound represented by general formula (II).

17. A silver halide photographic light-sensitive element as claimed in claim 1, wherein the nitron compound is an inorganic acid salt of nitron or an organic acid salt of nitron.

18. A silver halide photographic light-sensitive element as claimed in claim 1, wherein the nitron compound is an organic acid salt of nitron.

19. A silver halide photographic light-sensitive element as claimed in claim 1, wherein the nitron compound is nitron salicylate.

20. A silver halide photographic light-sensitive element as claimed in claim 1, wherein the polyoxyethylene surface active agent represented by the general formulae (I) or (II) is present in an amount of from about 5 mg to 500 mg per $m^2$ of the photographic light-sensitive material.

21. A silver halide photographic light-sensitive element as claimed in claim 1, wherein the nitron compound is present in an amount of from about $10^{-8}$ mol to $10^{-1}$ mol per g of silver atom.

22. A silver halide photographic light-sensitive element as claimed in claim 1, wherein the polyoxyethylene surface active agent and the nitron compound are present in the same layer of the photographic light-sensitive material.

23. A silver halide photographic light-sensitive element as claimed in claim 1, wherein the polyoxyethylene surface active agent and the nitron compound are present in different layers of the photographic light-sensitive material.

24. A silver halide photographic light-sensitive element as claimed in claim 1, wherein the polyoxyethylene surface active agent is present in a light-sensitive emulsion layer or a light-insensitive auxiliary layer.

25. A silver halide photographic light-sensitive element as claimed in claim 1, wherein the nitron compound is present in a light-sensitive emulsion layer.

26. A silver halide photographic light-sensitive element as claimed in claim 1, wherein the polyoxyethylene surface active agent is present in a light-insensitive auxiliary layer and the nitron compound is present in a light-sensitive emulsion layer.

* * * * *